United States Patent [19]

Wu

[11] 4,262,892

[45] Apr. 21, 1981

[54] QUICK-OPERATING BENCH VISE

[76] Inventor: Rong-Chun Wu, No. 12, La. 110, Kwung Lung St., Bar Deh Village, Tao Yuan Hsien, Taiwan, 334

[21] Appl. No.: 123,784

[22] Filed: Feb. 22, 1980

[51] Int. Cl.[3] ..... B25B 5/10

[52] U.S. Cl. ..... 269/181; 269/247

[58] Field of Search ..... 269/181–183, 269/246, 247

[56] References Cited

U.S. PATENT DOCUMENTS

| | | | |
|---|---|---|---|
| 347,365 | 8/1886 | Montant | 269/247 X |
| 825,151 | 7/1906 | McLean | 269/181 |
| 2,881,645 | 4/1959 | Kruchten | 269/181 X |

*Primary Examiner*—Robert C. Watson

*Attorney, Agent, or Firm*—Robert E. Burns; Emmanuel J. Lobato; Bruce L. Adams

[57] ABSTRACT

A quick-operating bench vise comprises a movable jaw with a slide and provided with a lead screw, a fixed jaw formed with a box shaped structure through which the slide of the movable jaw is accommodated, a clutching device including a half nut for engaging with and disengaging from the lead screw and a sector gear device operating in association with the lead screw. By turning the lead screw counterclockwise with the handle provided on the end thereof, the half nut is disengaged from the lead screw to permit quick moving of the movable jaw by pulling or puhing and by turning the lead screw clockwise, the half nut is engaged with the lead screw for clamping or releasing the work piece.

2 Claims, 5 Drawing Figures

QUICK-OPERATING BENCH VISE

BACKGROUND OF THE INVENTION

This invention relates to bench vises, and more particularly to a quick-operating bench vise in which quick movement of the movable jaw is permitted by turning the lead screw adapted for clamping and releasing the work piece.

In a workshop, a bench vise is an essential means for holding a work piece. The movable jaw of a bench vise normally operates with a lead screw engaging with a nut fixed to or formed integrally with the fixed jaw. The lead screw is operable with a handle provided on its end, and by turning this handle clockwise the movable jaw is moved toward the fixed jaw, and by turning it counterclockwise the movable jaw is moved away from the fixed jaw. A drawback arises with the above described conventionally known bench vise when the work piece is extremely large or extremely small, requiring the movable jaw to be moved along its full length of travel to accommodate and clamp the work piece. One has to crank the handle a good number of turns to move the movable jaw the needed distance.

DESCRIPTION OF PRIOR ART

To resolve the aforesaid problem there has been a bench vise of quick operating type. The inventor is aware of a type that adapts a nut only embracing the lower portion of the lead screw, the nut being capable of disengaging from it by the operation of a trigger at the front of the movable jaw, the trigger being an independent member having no association with the lead screw. The quick-operating bench vise of this type requires the operation of the trigger in addition to the operation of the handle of lead screw, which is virtually an added non productive operation.

The inventor is not aware of any other prior art pertaining to the present invention.

DETAILED DESCRIPTION OF THE INVENTION

This invention relates to a quick-operating bench vise in which quick movement of the movable jaw is permitted by turning the lead screw adapted for clamping and releasing the work piece without the need of operating a separate device.

As previously described, the conventional bench vise has the disadvantage of requiring excessive turning of the lead screw when the movable jaw has to be moved a long distance for accommodating and clamping a work piece and a known quick-operating type has the disadvantage of requiring the operation of a trigger. The quick-operating bench vise according to the present invention, however, permits the quick operation of the movable jaw by simply turning the lead screw which is a normal essential element of the device in this field of art, thus eliminating the inconveniency and disadvantages of conventional devices.

Therefore, it is the main object of this invention to provide a quick-operating bench vise that permits the quick movement of the movable jaw by turning the lead screw.

The construction, operation, features and further objects of the present invention will be more fully understood from the following description taken in conjunction with the accompanying drawings, in which.

Figures 1, 1A:
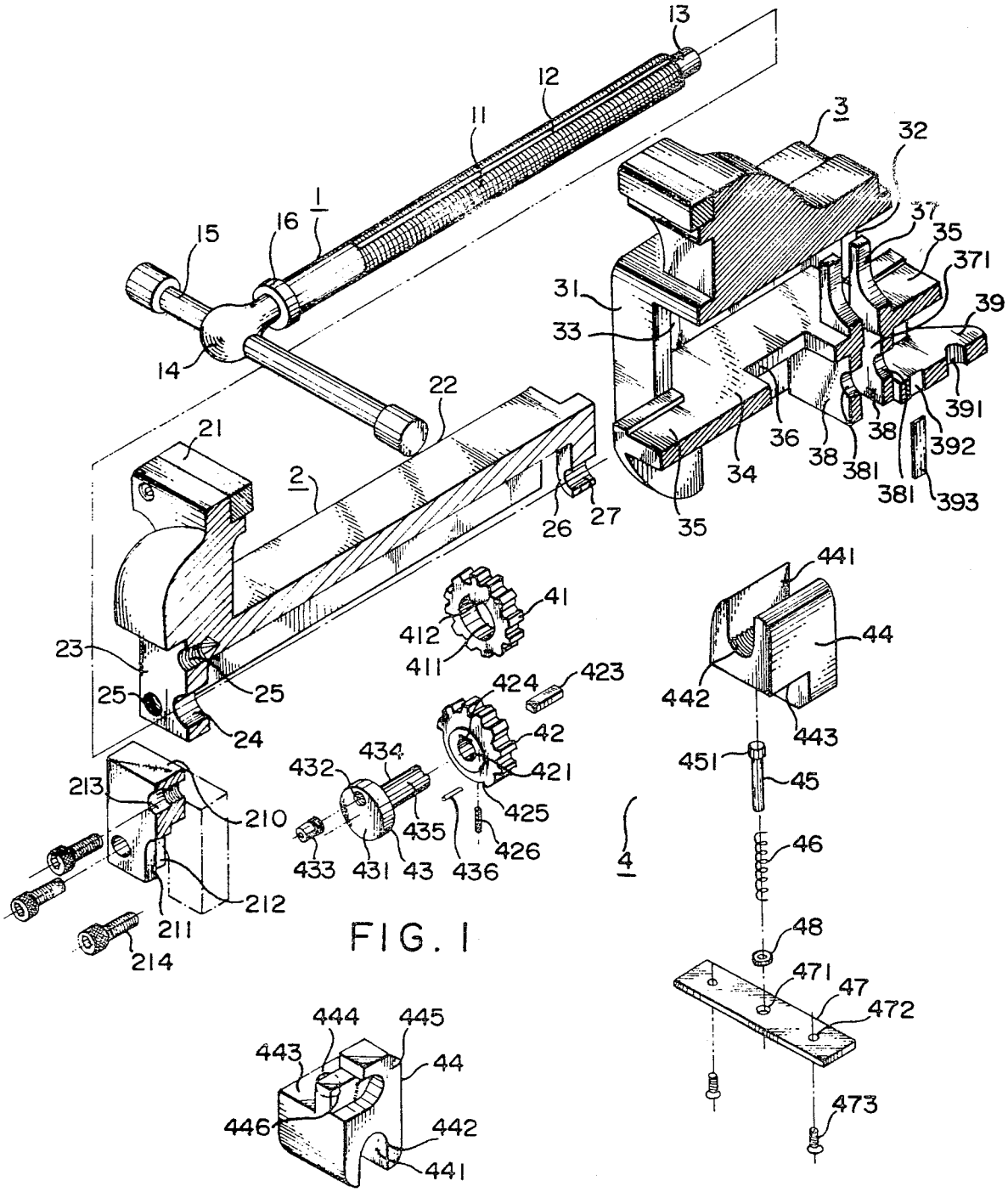
FIG. 1 is an exploded, oblique view, with both the movable and fixed jaws in section, of an embodiment of the present invention.
FIG. 1A is an oblique, perspective view of the half nut with its top side down showing the detail of its bottom side.
Figure 2:
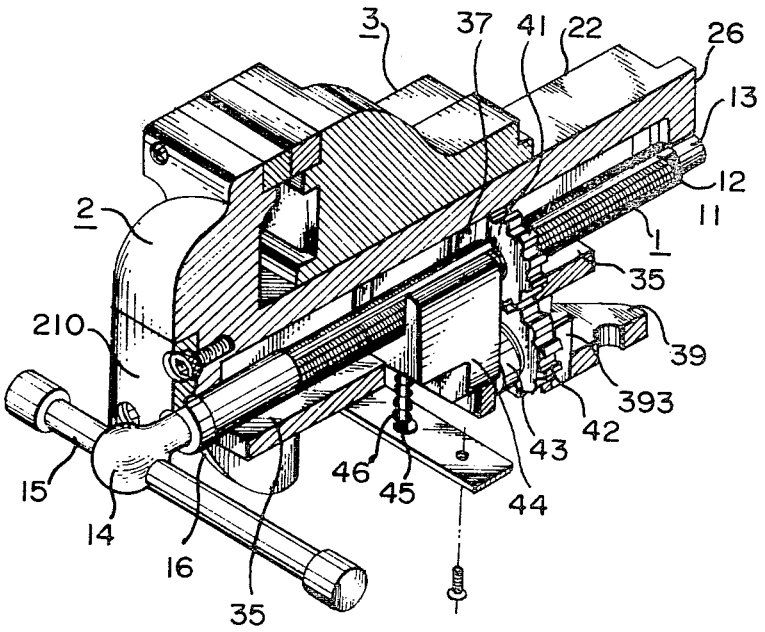
FIG. 2 is an oblique, partially cut away, perspective view of the embodiment of the present invention, with all components shown in FIG. 1 assembled.

It is to be understood that in the following description the direction toward the operator who operates the device is regarded as the front and the direction away from the operator as the rear.

Referring now to the drawing, the quick-operating bench vise of this invention mainly comprises a movable jaw 2, a fixed jaw 3, a lead screw 1, and a clutching device 4 including a half nut 44. The movable jaw 2 is casted substantially in an L shape having a clamping jaw 21 and an elongated slide 22 formed intergrally; the slide 22 having an inverted U shaped cross section, a rear end plate 26 and a front end plate 23; the rear end plate 26 being provided with a hole 27 for receiving the rear end extension 13 of the lead screw 1; the front end plate being provided with a hole 24 through which the lead screw 1 is inserted and supported at its neck portion, and threaded holes 25 in which the cap screws 214 for fastening the front cover plate 210 are mounted.

The lead screw 1 is a round rod having screw thread 11 of sawtooth shape in cross section with the vertical surface of the thread facing the front and the inclined surface facing the rear, and a slot 12 cut along the entire length of the threaded portion, a short extension 13 of smaller diameter at the rear end, a flange 16 at the front end portion and the head 14 on the front end through which a handle 15 is loosely inserted.

The fixed jaw 3 is formed with a clamping jaw on top, and a box-shaped structure integrally below with a front wall 31 and a rear wall 32 each provided with a rectangular opening 33 through which the slide 22 of the movable jaw may be inserted; said box shaped structure being provided with a horizontal partition 34 having extended portions 35 toward the front and the rear respectively; said horizontal partition 34 having a rectangular opening 32 formed substantially in its central portion for accommodating the half nut 44 which will be described later; a pair of brackets 37 protruding upwardly behind the rectangular opening 36, said brackets each having a U-shaped opening through which the lead screw 1 may be extended; said pair of brackets 37 also extending downwardly to merge with a pair of vertical partitions 38 underneath the horizontal partition 34 to form a through compartment 371 between the pair of brackets 37 and between the pair of vertical partitions 38 for accommodating a driving pinion 41 and a sector gear 42 which will be described later. The pair of vertical partitions 38 are provided with holes 381 for supporting a shaft 43 on which the sector gear 42 is mounted.

The fixed jaw 3 is also provided with mounting flanges 39 extending sidewards and rearwards flush with the bottom surface of the box shaped structure, each flange 39 having a mounting hole 391 through which the mounting bolt, not shown, may be placed to fasten the fixed jaw 3 onto a bench. In the central portion of the rear flange 39 behind the rear vertical partition 38 a slot 392 is provided for fixedly inserting a spring plate 393 to serve as a resilient stop means against the rotation of the shaft 43 at a certain point.

The clutching device 4 comprises a half nut 44, a driving pinion 41, a sector gear 42 and a shaft 43. The half nut 44, as shown in FIGS. 1 and 1A, is formed with a U-shaped groove 441 having on its bottom surface a half threaded portion 442 capable of engaging with the lower half of the lead screw 1. A portion of the bottom side of the half nut 44 is formed into a flat surface 443 having a recess 444 substantially in its central portion for fixedly receiving the head 451 of the supporting pin 45. The bottom side and the back side of the half nut are shown in FIG. 1A. As shown in the drawing, the back side of the extended portion 445 of the half nut 44 is provided with a groove 446 so arranged to be engaged with the stud bolt 433 mounted on the shaft 43 when the clutching device, as will be described later, is operated to disengage the half nut 44 from the lead screw 1.

Figure 3A:
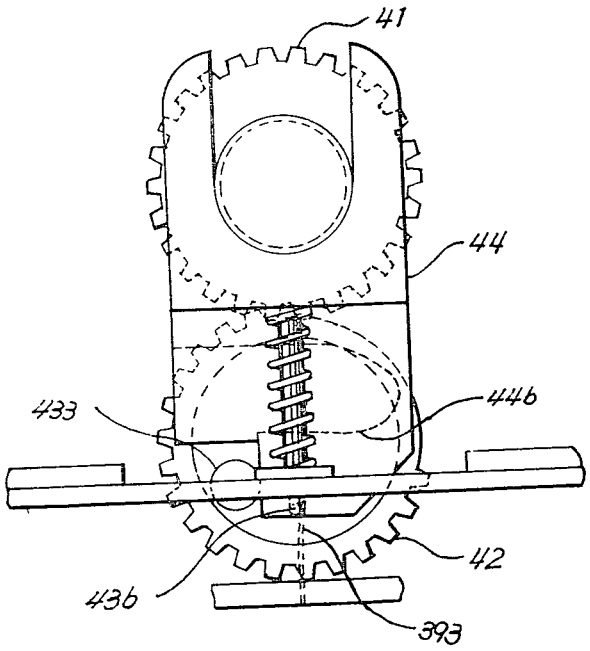
FIG. 3A is an explanatory drawing showing the relations among the lead screw and the clutching device when the half nut is engaged with the lead screw.

The driving pinion 41 has a key means 412 securely fixed to or integrally formed on the periphery of its bore 411, and is disposed in the compartment 371 between the pair of brackets 37 and is slidably mounted on the lead screw 1 with its key means 412 slidably fitting in slot 12. The gear teeth of the sector gear 42 mesh with those of the driving pinion 41, said gear teeth being disposed around approximately two thirds ($\frac{2}{3}$) of the periphery thereof, leaving the remaining one third ($\frac{1}{3}$) with a smooth circular surface of a diameter smaller than the root diameter of the toothed portion. The sector gear 42 as described is provided with a keyway 424 on the periphery of its bore 421 for the key 423 by means of which the sector gear 42, being disposed in the compartment 371 between the pair of vertical partitions 38, is fixedly mounted on the shaft 434 which is inserted through the holes 381 on the vertical partition 38. The sector gear 42 as described is further fixed by a set screw 426 to the shaft 434 through a threaded hole 425 (not shown). The wheel shaft 43 is formed integrally with a disc 431 and a shaft 434, the disc 431 having an eccentric, threaded hole 432 in which a stud bolt 433 is fixed; the angular position of said eccentric, threaded hole 432 with respect to the sector gear 42 when mounted on the shaft 434 substantially corresponds to the middle portion of the toothed portion of the sector gear 42, the shaft 434 having a keyway 435 to receive the key 423 so as to securely engage with the sector gear 42. A pin 436 is fixed in the suitable position at the rear end of the shaft 434, and is so arranged that it abuts on the spring plate 373 to produce resilent force against the pin itself when the shaft 434 is turned and said pin 436 comes to the lowest position, that is when the half nut 44 is engaged with the lead screw 1 and the sector gear 42 is just disengaged from the driving pinion 41, as shown in FIG. 3A.

The lead screw 1 is assembled with the movable jaw 2, with the rear end extension 13 supported by the rear end plate 26 and the neck portion behind the flange 16 supported by the front end plate 23, and is retained by the cover plate 210 having a U-shaped opening 211 and recess 212 which receives the flange 16, said cover plate 210 being fastened to the front end plate 23 with cap screws 214. In assembling, first insert the slide 22 of the movable jaw 2 into the box-shaped structure of the fixed jaw 3 through the rectangular opening 33; as the end plate 26 is formed to be able to pass through the U-shaped opening of the brackets 37, and also the slide 22 is designed to be able to pass along the top and the sides of the brackets 37, the slide 22 can be inserted all the way in and be slidably movable along the upper surface of the horizontal partition 34 and extensions 35; then place from below the driving pinion 41 in the compartment 371 and align its center axis with that of the holes 24 and 27 and then insert the lead screw 1 from the front end of movable jaw 2 through the hole 24, the U-shaped opening of the front bracket 37, the bore of the driving pinion 41, the U-shaped opening of the rear bracket 37, untill the rear end extension 13 is inserted in the hole 27 on the rear end plate 26. It is to be understood that the key means 412 of the driving pinion 41 slidably fits into the slot 12 when mounted on the lead screw as described.

The sector gear 42 is arranged in the lower part of the compartment 371 between the vertical partitions 38, and is mounted on the shaft 434 by holding it from below and inserting the shaft 434 from front into the hole 381 of the front vertical partition 38, the bore of the sector gear 42 and the hole 381 of the rear vertical partition 38. It is to be understood that the key 423 is fit in place during the aforesaid process, as previously introduced. The shaft 434 is arranged parallel with the lead screw with the distance between the two center axes corresponding to the sum of the radii of the pitch circle of the driving pinion 41 and that of the sector gear 42 so that the sector gear can mesh with the driving pinion 41.

When assembling the shaft 434 with the sector gear 42, the disc 431 is left without the stud bolt 433 which is to be fixed after the half nut 44 is put in place.

The half nut 44 is put in place from below through the opening 36 so that its U-shaped groove embraces the lead screw 1 and is supported by the supporting plate 47 through the coil spring 46, said coil spring 46 being slid over the supporting pin 45, said supporting pin 45 being slidably inserted into hole 471 prepared in the supporting plate 47 which is fastened onto the bottom edges of the side walls of the box-shaped structure with the cap screws 473. The half nut 44 installed as described is thus guided by the edges of the opening 36 and constantly urged upwards by the spring 46 and is capable of moving vertically along the edges of the opening 36. When the half nut 44 is raised to engage with the lower half portion of the threaded portion 11 of the lead screw 1, the movable jaw 2 can be moved only by turning the lead screw 1, and when it is lowered to disengage from the lead screw 1, the movable jaw 2 is free to be pushed toward or pulled away from the fixed jaw 3.

The operation of the clutching device 4, including the half nut 44 will now be described.

Referring to FIG. 3A, the clutching device with the half nut 44 engaged with the lead screw 1 is shown as seen from the front. In this state the sector gear 42 is disengaged from the driving pinion 41 when its toothed portion has rotated counterclockwise past the teeth of the driving pinion 41, leaving the last tooth at the position of where it is disengaged and the stud bolt 433 is at its lowest position on the left hand side. In the meantime the pin 436 at the rear end of the shaft 434 is at its lowest position forcing the spring plate 393 to bend resiliently slightly, said spring plate 393 thus urging the pin 436 but because of the frictions the shaft 434 will not be rotated by the resilient force of the spring plate.

To move the movable jaw 2 freely, first turn the lead screw 1 with the handle 15 counterclockwise approximately two thirds (⅔) of one turn, and the driving pinion 41 is rotated with the lead screw 1. As soon as the driving pinion 41 is rotated counterclockwise, the movement of the driving pinion 41 overcomes the frictions in favor of the resilient force exerted on the shaft 434 by the spring plate 393, and as a result, the sector gear 42 is rotated clockwise slightly to move the last tooth back in the engagement with the driving pinion 41. Consequently the sector gear 42 is driven to rotate in the opposite direction or clockwise by the driving pinion 41 as it is rotated.

Figure 3B:
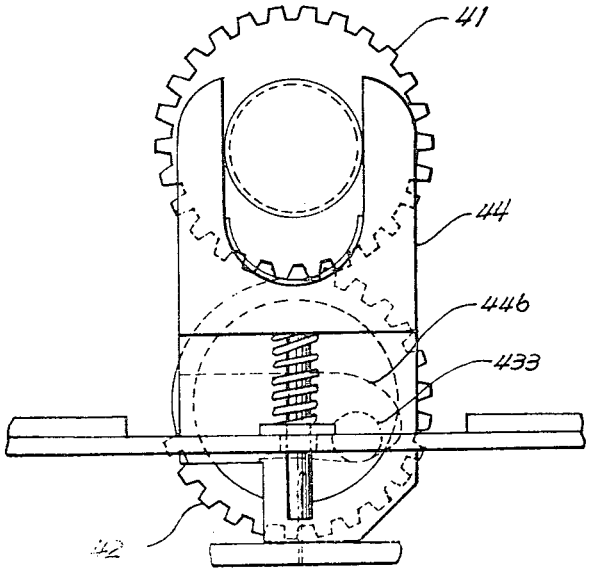
FIG. 3B is an explanatory drawing showing the relations among the lead screw and the clutching device when the half nut is disengaged from the lead screw.

As soon as the sector gear 42 is rotated clockwise the stud bolt 433 revolves around the axis of shaft 434 on which the sector gear 42 is mounted to engage with the groove 446 and pull the half nut 44 down. As previously mentioned, the half nut 44 is guided by the edges of the opening 36 and is permitted to move vertically, it moves downwardly when the stud bolt 433 revolves clockwise over its highest position to the right and descends from there, until the toothed portion of the sector gear 42 is rotated over to the right and disengaged from the driving pinion 41 as shown in FIG. 3B. Because the half nut 44 is supported and urged by the spring 46, it tends to move upwardly when the external force which is the pushing force exerted by the stud bolt 433 is relieved as the sector gear 42 is disengaged from the driving pinion 41, and as a result, the spring 46 pushes up the half nut 44 which urges the stud bolt 433 to revolve counterclockwise. Consequently the sector gear 42 is urged counterclockwise to keep the last tooth of the sector gear 42 always in contact with a tooth of the driving pinion 41.

As soon as the half nut 44 is pushed downward, it is disengaged from the lead screw 1 and free movement of the movable jaw 2 is permitted. A quick operation of the vise is thereby made possible.

To clamp a work piece after the movable jaw has been moved freely as described, simply turn the lead screw 1 approximately two thirds (⅔) of one turn with the handle 15 clockwise. As soon as the lead screw 1 is turned clockwise, the driving pinion 41 is rotated clockwise, and as previously described, the sector gear 42 is always being urged by the spring 46 through the half nut 44 and the stud bolt 433; therefore the sector gear 42 is pushed to engage with the driving pinion 41 when the driving pinion 41 rotates clockwise. Consequently, the sector gear 42 is driven to rotate counterclockwise till the toothed portion is rotated over to the left and disengaged from the driving pinion, and the stud bolt revolves accordingly over to the left and is disengaged from the groove 446 of the hald nut 44, and as a result, the half nut 44 is pushed up by the spring 46 to engage with the lead screw. Then the movable jaw 2 can be, or can only be, moved by turning the lead screw. Since in this state the sector gear 42 has been disengaged from the driving pinion 41 and the half nut 44 is constantly urged by the spring 46 to engage with the lead screw 1, the lead screw 1 can be turned as many turns as needed to clamp the work piece.

The cross section of the screw thread 11 of the lead screw is of sawtooth-shape with its vertical surface facing the front end. The pressure produced by clamping on the lead screw is exerted on the vertical surface of the screw thread giving no component force to push down the half nut 44 when the lead screw 1 is turned to clamp the work. In the meantime the inclined surface of the screw thread 11 facing the rear end tends to push down the half nut 44 to clear from the lead screw 1 when the half nut 44 is not completely disengaged from the lead screw 1 and the movable jaw 2 is pushed by hand to move toward the fixed jaw.

A preferred embodiment of the present invention is described as above, by way of example. It is to be understood, however, that further modifications can be made without departing from the scope of the invention as defined in the appended claims.

I claim:

1. A quick-operating bench vise comprising a movable jaw, a fixed jaw, a lead screw for turning to move the movable jaw toward and away from the fixed jaw, and a clutching device operable by said lead screw; the lead screw having a screw thread of sawtooth type in cross section with the vertical surface of the screw thread facing the front end, and a slot longitudinally cut along the entire length of the screw thread; the movable jaw having an elongated slide in which said lead screw is mounted with its front end protruding outwardly, said elongated slide of the movable jaw being slidably inserted in the lower structure of the fixed jaw; the clutching device comprising a half nut urged by a spring toward the lead screw and capable of moving toward and away to engage with and disengage from the lead screw along a radial direction, a driving pinion slidably mounted on said lead screw with a key means fitting in said slot and capable of rotating with the lead screw, a sector gear having teeth around a portion of the circumference for engaging with the driving pinion and the remaining non-toothed portion being of a diameter smaller than that of the root diameter of the toothed portion, and a shaft on which said sector gear is fixedly mounted having a stud eccentrically mounted on the enlarged end thereof; said stud being arranged to substantially correspond with the middle portion of the toothed portion of the sector gear and being capable of engaging with a slot formed on the half nut to push the half nut away from and thus disengage from the lead screw when it revolves less than one turn around the axis of said shaft in one direction, and disengaging from that slot to allow the half nut to move toward and engage with the lead screw by the resilient force of said spring when it revolves less than on turn in the opposite direction.

2. A quick-operating bench vise according to claim 1, wherein a resilent stop means is provided on the rear portion of the lower structure of the fixed jaw to resiliently stop the rotation of the shaft of the sector gear in association with a pin means protruding eccentrically from the rear end of said shaft when said half nut is engaged with the lead screw and said stud is disengaged from the half nut.

* * * * *